US009938940B2

(12) United States Patent
Born et al.

(10) Patent No.: US 9,938,940 B2
(45) Date of Patent: Apr. 10, 2018

(54) INTAKE MANIFOLD

(75) Inventors: David Born, Commerce Township, MI (US); John Carl Lohr, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1368 days.

(21) Appl. No.: 12/764,158

(22) Filed: Apr. 21, 2010

(65) Prior Publication Data

US 2011/0259293 A1 Oct. 27, 2011

(51) Int. Cl.

*F02M 35/104* (2006.01)
*F02M 35/116* (2006.01)
*F02M 35/10* (2006.01)

(52) U.S. Cl.

CPC ..... *F02M 35/116* (2013.01); *F02M 35/10* (2013.01); *F02M 35/1034* (2013.01); *F02M 35/10052* (2013.01)

(58) Field of Classification Search

CPC .. F02M 35/00; F02M 35/10; F02M 35/10032; F02M 35/1034; F02M 35/10347; F02M 35/1277; F02M 35/116; F02M 35/10052

USPC ..... 123/184.21, 184.61, 184.56, 184.34, 123/184.31, 184.55, 184.46, 547; 248/67, 248/346.01, 346.02, 346.4

See application file for complete search history.

(56) References Cited

U.S. PATENT DOCUMENTS 2,882,875 A 4/1959 Kolbe
3,780,715 A 12/1973 Flitz
3,931,811 A 1/1976 McFarland, Jr.
4,413,607 A * 11/1983 Batchelor et al. ..... 123/590
4,470,378 A * 9/1984 Malik et al. ..... 123/184.42
4,765,286 A * 8/1988 Lyjak et al. ..... 123/184.55
5,094,194 A * 3/1992 Rush et al. ..... 123/184.42
5,245,955 A * 9/1993 Husted ..... 123/184.61
5,494,011 A 2/1996 Haller
5,877,576 A 3/1999 CoChimin
5,901,677 A 5/1999 Ohrnberger et al.
6,038,769 A * 3/2000 Bonny et al. ..... 29/890.08
6,070,585 A 6/2000 Fery et al.
7,082,915 B2 * 8/2006 Tanikawa et al. ..... 123/184.42
7,178,504 B2 * 2/2007 Huhn et al. ..... 123/336
7,458,553 B2 * 12/2008 Tzur et al. ..... 248/346.02
2004/0149258 A1 * 8/2004 Yamamoto et al. ..... 123/337
2005/0005888 A1 * 1/2005 Brassell et al. ..... 123/184.31
2005/0235941 A1 10/2005 Gessner et al.
2008/0187447 A1 * 8/2008 Steinfels et al. ..... 417/234
2008/0210189 A1 9/2008 Boyes et al.
(Continued)

*Primary Examiner* — Jacob Amick

(74) *Attorney, Agent, or Firm* — Greg Brown; Brooks Kushman P.C.

(57) ABSTRACT

An intake manifold assembly has one or more shells coupled together and coupled to a cover. When the manifold cover, or other exterior surface, is rounded, the manifold does not sit stably on a flat surface when the rounded surface is placed onto the flat surface. The manifold may roll off a table and be damaged. To mitigate such situation, the rounded surface is provided with at least two standoffs extending outwardly from a surface of the cover with distal ends of the standoffs substantially lying in a common plane. The standoffs have a central axis and the standoffs extend outwardly from the surface along the central axis at least as far as any other feature of the intake manifold assembly.

17 Claims, 2 Drawing Sheets

(56) References Cited

U.S. PATENT DOCUMENTS

| | | | | |
|---|---|---|---|---|
| 2009/0301423 | A1* | 12/2009 | Usuda | 123/184.42 |
| 2010/0059010 | A1* | 3/2010 | Fijas | 123/184.61 |
| 2010/0326395 | A1* | 12/2010 | Lohr | 123/198 E |
| 2011/0005488 | A1* | 1/2011 | Reese et al. | 123/184.61 |

* cited by examiner

INTAKE MANIFOLD

BACKGROUND

1. Technical Field

The present development relates to intake manifold assemblies.

2. Background Art

During the manufacture of an internal combustion engine, various parts or assemblies are transported to and among manufacturing stations. Parts or assemblies that have rounded surfaces may not sit stably on a flat surface. In some cases, a special fixture is provided to make the part easier to handle and to prevent the part from rolling and possibly falling and becoming damaged. Sometimes parts that are found to be slightly out of specification are taken to a special station for repair, which provides another opportunity for the part to be improperly secured and suffer damage. Additionally, in dealer service, parts may be removed and set aside for later reassembly. Perfectly usable parts may be rendered as scrap in the case of damage, increasing manufacturing cost and material waste.

SUMMARY

To at least partially mitigate the propensity to roll, an intake manifold assembly includes a housing having a rounded outside surface and at least one standoff extending outwardly from the outside surface with a distal end of the standoff substantially lying in a common plane with at least two spaced portions of the outside surface. The standoff has a central axis and the standoff extends outwardly from the outside surface along the central axis at least as far as any other feature of the intake manifold outside surface. In some embodiments, the outside surface includes a polygonal web and the distal end of the standoff is an elongated polygonal web portion. The elongated polygonal web portion includes a planar end with the planer end coplanar with the common plane. A longitudinal plane is perpendicular to the common plane; and the longitudinal plane is coincident with a center of gravity of the intake manifold. The standoff is displaced from the longitudinal plane.

In some embodiments, at least one of the two spaced portions of the outer surface is a second standoff extending outwardly from an adjacent portion of the outside surface. In the case of two standoffs, they straddle the longitudinal plane.

An intake manifold assembly has one or more shells coupled together and coupled to a cover. When the manifold cover, or other exterior surface, is rounded, the manifold does not sit stably on a flat surface when the rounded is placed onto the flat surface. The manifold may roll off a table and be damaged. To overcome such situation, the rounded surface is provided with at least two standoffs extending outwardly from a surface of the cover with distal ends of the standoffs substantially lying in a common plane. The standoffs have a central axis and the standoffs extend outwardly from the surface along the central axis at least as far as any other feature of the intake manifold assembly. An interface between the cover and the middle shell lies in an interface plane. The interface plane and the common plane are roughly parallel. The cover has a longitudinal plane which is coincident with a center of gravity of the assembly and perpendicular to the interface place. In some embodiments, a pair of the standoffs is substantially symmetrically located with respect to the longitudinal plane and at least one-third of a cover width apart.

In some embodiments, the intake manifold has a longitudinal plane perpendicular to the common plane and the longitudinal plane intersects a center of gravity of the intake manifold. One pair of the standoffs is substantially symmetrical with respect to the longitudinal plane. The pair of standoffs straddles the center of gravity of the intake manifold with respect to the longitudinal plane.

The standoffs are circular, hexagonal, or any other suitable shape in cross section. The intake manifold is made of a composite material, an aluminum alloy, or any other suitable material. The standoffs are integral to the cover. In some embodiments, the intake manifold may be formed from a single casting or injection molding. In some embodiments, the intake manifold includes multiple shells sandwiched together; the shells are made of a composite material; and the shells are adhered together via one of friction welding and an adhesive. The standoffs are integral to the intake manifold.

An intake manifold, according to one embodiment, includes a first shell; a rounded cover coupled to the first shell at a coupling interface; and two standoffs extending outwardly from an exterior surface of the cover with distal ends of the standoffs substantially lying in a common plane. The cover has a longitudinal plane perpendicular to the coupling interface and the standoffs straddle a center of gravity of the intake manifold and the lengthwise plane. The standoffs extend outwardly from the exterior surface of the cover beyond any other feature of the intake manifold assembly. In some embodiments, the standoffs are substantially symmetric with respect to the longitudinal plane. Some embodiments include four standoffs with at least one pair of standoffs substantially symmetric with respect to the longitudinal plane.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
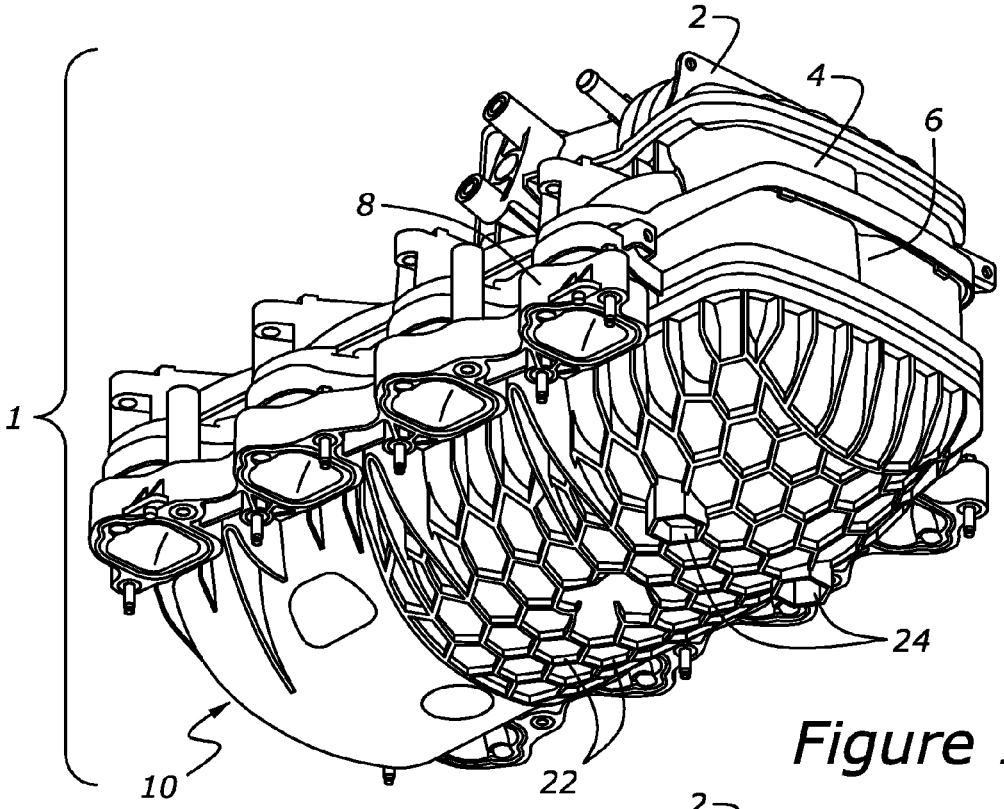
FIGS. 1 and 2 are isometric views of an intake manifold assembly.

An isometric view of an intake manifold assembly 1 in FIG. 1 shows a throttle body shell 2, a top shell 4, a middle shell 6, a bell mouth shell 8, and a cover 10. In this embodiment, cover 10, in cooperation with bell mouth shell 8, defines a plenum. The example shown in FIG. 1 is not intended to be limiting. Alternatively, a cover, similar to cover 10, can couple with fewer parts to form an assembly. Assembly 1 is made from a composite material and has hexagonal features 22 on much of the exterior surface to provide stiffness to mitigate vibration and noise. At least two of the hexagonal features extended outwardly (downwardly as shown in FIG. 1) from cover 10 to form standoffs 24. The distal ends of standoffs 24 lie in a common plane. If the cover 10 side of manifold 1 is set upon a flat surface, the distal ends of standoffs 24 sit upon the flat surface thereby mitigating roll over of manifold 1. Manifold 1 is packaged in an engine compartment. The location of standoffs 24 are selected in such that they do not interfere with other parts in the engine compartment. Thus, the locations of standoffs 24 in FIG. 1 are provided as simply one example.

Figure 2:
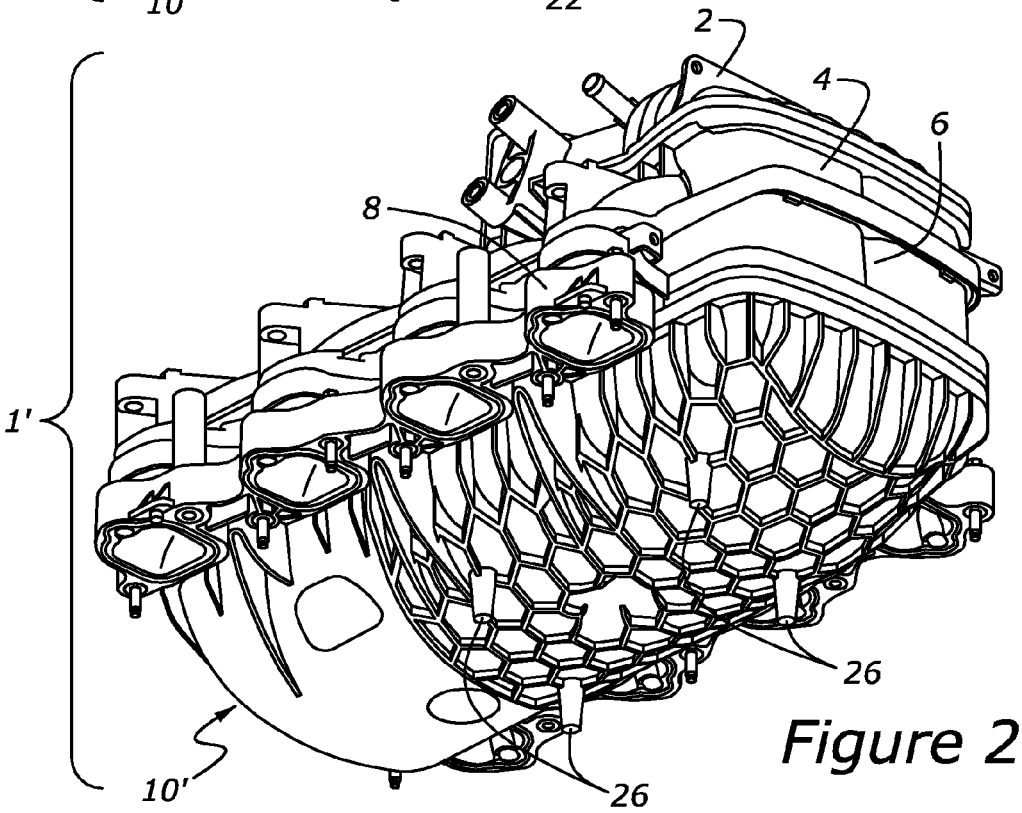

An isometric view of an intake assembly 1' is shown in FIG. 2. Intake assembly 1' in FIG. 2 is identical with intake assembly 1 of FIG. 1, except that cover 10' has four cylindrical standoffs 26 extending downwardly from cover 10' as opposed to two hexagonal standoffs 24 in FIG. 1.

Figure 3:
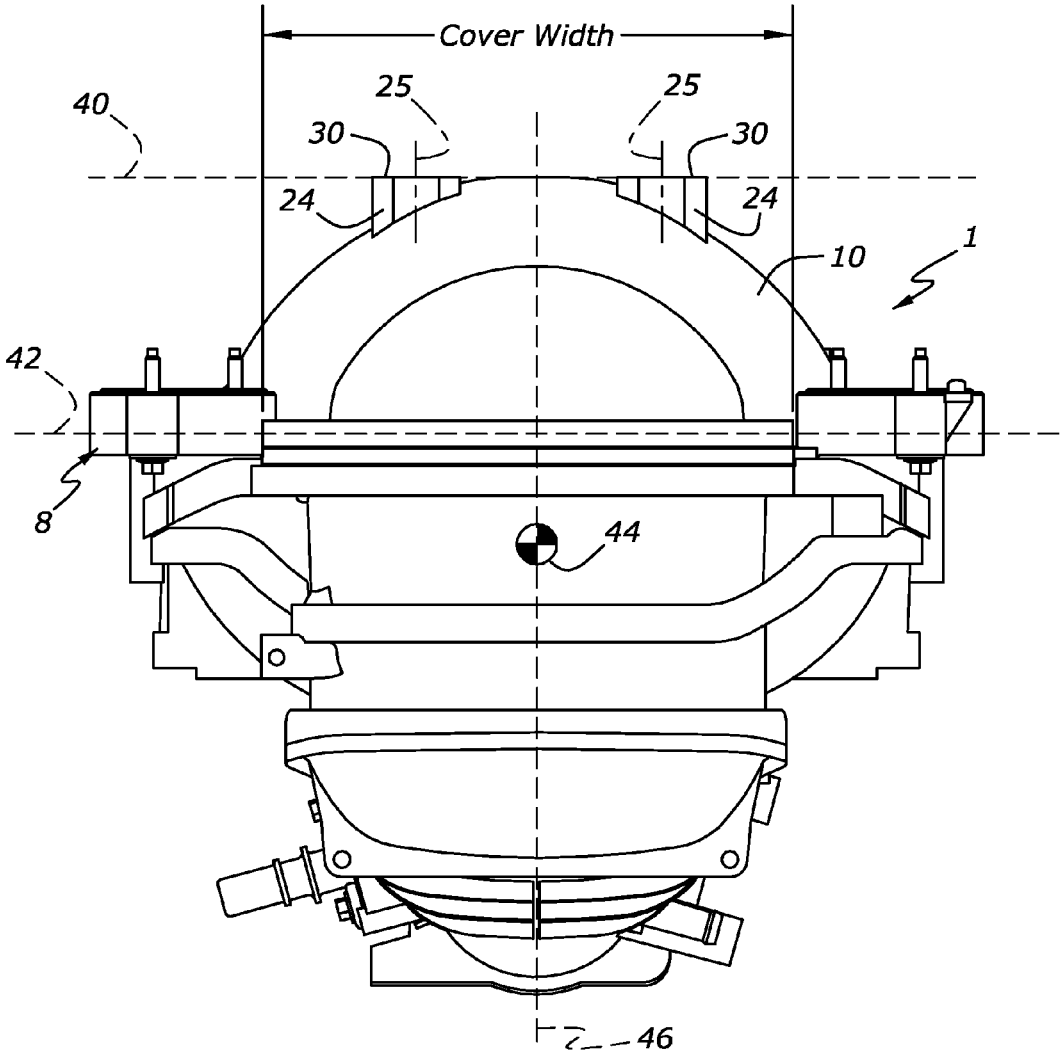
FIG. 3 is an end view of the intake manifold assembly shown in FIG. 1.

An end view of intake assembly 1 is shown in FIG. 3. Standoffs 24 have a central axis 25 and extend outwardly from cover 10 along the direction of central axis 25. Distal ends 30 of standoffs 24 lie in a common plane 40. In the embodiment in FIG. 3, common plane 40 is roughly perpendicular to central axes 25. Distal ends 30 of standoffs 24 extend away from cover 10 farther in an outward direction along central axes 25 than any other feature, or surface, associated with cover 10 or with manifold 1. Cover 10 couples with bell mouth shell 8 along an interface plane 42. In the embodiment in FIG. 3, interface plane 42 is substantially parallel with common plane 40. A longitudinal plane 46 is substantially perpendicular with common plane 40 and is coincident with a center of gravity 44 of intake manifold 1. A pair of standoffs straddles longitudinal plane 46. In one embodiment, the pair is placed symmetrically with respect to longitudinal plane 46. In some embodiments, the pair straddles the longitudinal plane 46 with a distance in between the two being at least one-third of a cover width.

As used herein, directional words such as upward, downward, and the like refer the position of an intake manifold assembly as shown in the Figures. In a typical installation on a conventional V-type engine, the throttle body is arranged at the top and the cover 10 at the bottom like in the Figures. Those of ordinary skill in the art will understand that these words are used for convenience only and should be adjusted accordingly for orientations other than that shown in the Figures. The orientation described should not be interpreted as limiting.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

What is claimed:

1. An intake manifold assembly, comprising:

a housing having a rounded outside surface; and at least one standoff extending outwardly from the outside surface and having a proximal end attached to the outside surface and a distal end opposite the proximal end and farther from the outside surface than the proximal end, the distal end of the standoff substantially lying in a common plane with at least two spaced portions of the outside surface.

2. The assembly of claim 1 wherein the housing has a longitudinal plane coincident with a center of gravity of the assembly, the standoff extending outwardly from the outside surface and increasingly extending farther outwardly from the outside surface along the common plane and away from the longitudinal plane.

3. The assembly of claim 1 wherein the housing includes an elongated polygonal web having an elongated polygonal web portion that comprises a planar end.

4. The assembly of claim 3 wherein the planar end is coplanar with the common plane.

5. The assembly of claim 1 wherein at least one of the two spaced portions of the outer surface comprises a second standoff extending outwardly from an adjacent portion of the outside surface.

6. The assembly of claim 5 wherein:

the housing comprises at least a cover and a middle shell coupled together;

an interface between the cover and the middle shell lies in an interface plane;

the cover has a longitudinal plane coincident with a center of gravity of the assembly and perpendicular to the interface plane;

the standoffs straddle the longitudinal plane; and the standoffs are at least one-third of a cover width apart.

7. The assembly of claim 1 wherein the housing is substantially comprised of a composite material.

8. The assembly of claim 1 wherein the housing is substantially comprised of an aluminum alloy.

9. The assembly of claim 1 wherein the housing comprises:

a throttle body shell coupled to a top shell;

a middle shell coupled to the top shell;

a bell mouth shell coupled to the middle shell; and a cover coupled to the bell mouth shell.

10. The assembly of claim 1 wherein:

the housing comprises at least a cover and a middle shell coupled together;

an interface between the cover and the middle shell lies in an interface plane;

the cover has a longitudinal plane coincident with a center of gravity of the assembly and perpendicular to the interface plane; and the standoff is displaced from the longitudinal plane.

11. An intake manifold having a convexly rounded exterior, comprising:

at least two standoffs extending outwardly from the convexly rounded exterior, each of the standoffs having a proximal end attached to the exterior and a distal end opposite the proximal end and farther from the exterior than the proximal end, the distal ends of the standoffs substantially lying in a common plane with at least two spaced portions of the exterior.

12. The intake manifold of claim 11 wherein the standoffs extend outwardly in a particular direction at least as far as any other feature of the intake manifold.

13. The intake manifold of claim 11 wherein:

the intake manifold has a longitudinal plane perpendicular to the common plane;

the longitudinal plane intersects a center of gravity of the intake manifold;

a pair of the standoffs is substantially symmetric with respect to the longitudinal plane; and the standoffs straddle the center of gravity of the intake manifold with respect to the longitudinal plane.

14. The intake manifold of claim 11 wherein the intake manifold comprises multiple shells sandwiched together, the shells are comprised of a composite material, and the shells are adhered together via one of friction welding and an adhesive.

15. An intake manifold, comprising:

a first shell;

a rounded cover coupled to the first shell at a coupling interface; and two standoffs extending outwardly from an exterior surface of the cover, each of the standoffs having a proximal end attached to the rounded cover and a distal end opposite the proximal end and farther from the rounded cover than the proximal end, the distal ends of the standoffs substantially lying in a common plane with at least two spaced portions of the cover wherein the cover has a longitudinal plane perpendicular to the coupling interface and the standoffs straddle a center of gravity of the intake manifold and the longitudinal plane.

16. The intake manifold of claim 15 wherein the standoffs extend outwardly from the exterior surface of the cover beyond any other feature of the intake manifold assembly.

17. The intake manifold of claim 15 wherein the standoffs are formed in one piece with the cover, one of the standoffs lies on one side of the longitudinal plane, and the other standoff lies on the other side of the longitudinal plane.

* * * * *